US010599090B2

(12) United States Patent
Hu et al.

(10) Patent No.: US 10,599,090 B2
(45) Date of Patent: Mar. 24, 2020

(54) PROCESS CARTRIDGE

(71) Applicant: JIANGXI YIBO E-TECH CO. LTD., Xinyu (CN)

(72) Inventors: Liangliang Hu, Xinyu (CN); Shiping Ao, Xinyu (CN)

(73) Assignee: JIANGXI YIBO E-TECH CO. LTD., Xinyu (CN)

( * ) Notice: Subject to any disclaimer, the term of this patent is extended or adjusted under 35 U.S.C. 154(b) by 0 days.

(21) Appl. No.: 16/571,353

(22) Filed: Sep. 16, 2019

(65) Prior Publication Data

US 2020/0012227 A1 Jan. 9, 2020

Related U.S. Application Data

(63) Continuation of application No. 16/408,559, filed on May 10, 2019, now Pat. No. 10,416,604, which is a continuation of application No. 16/013,300, filed on Jun. 20, 2018, now Pat. No. 10,338,513.

(30) Foreign Application Priority Data

| | | |
|---|---|---|
| Apr. 18, 2018 | (CN) | 2018 2 0552928 |
| Apr. 20, 2018 | (CN) | 2018 2 0571078 |
| Apr. 21, 2018 | (CN) | 2018 2 0573264 |
| May 4, 2018 | (CN) | 2018 2 0657416 |

(51) Int. Cl.
*G03G 15/00* (2006.01)
*G03G 15/08* (2006.01)

(52) U.S. Cl.
CPC ..... *G03G 15/757* (2013.01); *G03G 15/0806* (2013.01); *G03G 15/0865* (2013.01); *G03G 15/80* (2013.01)

(58) Field of Classification Search
CPC ..... G03G 15/757; G03G 15/0806; G03G 15/0865; G03G 15/80
See application file for complete search history.

(56) References Cited

U.S. PATENT DOCUMENTS

2008/0260428 A1* 10/2008 Ueno ..... G03G 21/186 399/167
2014/0270845 A1* 9/2014 Kawakami ..... G03G 21/1671 399/110

FOREIGN PATENT DOCUMENTS

WO 2019170017 A1 9/2019

* cited by examiner

*Primary Examiner* — Gregory H Curran
(74) *Attorney, Agent, or Firm* — IPro, PLLC; Qian Gu

(57) ABSTRACT

Disclosed herein is a process cartridge comprising: a housing; a rotatable component; a driving force receiver configured to transmit a driving force to the rotatable component; an elastic member; wherein when the process cartridge is installed in an imaging device comprising a driving head, the driving force receiver has a first state and a second state relative to the driving head, the first state being a state in which the driving force receiver contacts the driving head and is in a pre-engaged position and the second state being a state in which the driving force receiver is engaged by the driving head; wherein when the driving force receiver is in the first state relative to the driving head, the elastic member is configured to urge the driving force receiver to transition from the first state to the second state as a result of rotation of the driving head.

9 Claims, 18 Drawing Sheets

PROCESS CARTRIDGE

CROSS REFERENCE TO RELATED APPLICATIONS

The disclosures of Chinese Patent Application No. 201820552928.4, Chinese Patent Application No. 201820571078.2, Chinese Patent Application No. 201820573264.X, Chinese Patent Application No. 201820657416.4, and U.S. patent application Ser. No. 16/013,300 are hereby incorporated by reference in their entirety.

BACKGROUND OF THE INVENTION

1. Field of the Invention

The present invention relates to a process cartridge detachably installed in an imaging device.

2. Description of the Related Art

A process cartridge is a cartridge that can be detachably installed in an imaging device body, and the cartridge as an integral unit includes an electrophotographic photosensitive component and at least one processor such as a charger, a developer, a cleaner and the like. As the process cartridge is detachably installed relative to the device body, the maintenance of the device is facilitated. An electrophotographic imaging device adopting an electrophotographic imaging mode operates in the following way: the electrophotographic photosensitive component using the light of the imaging device to achieving uniform charging of the charger is subjected to selective exposure to form an electrostatic latent image, the latent image is developed by the developer into a toner image by using a toner, and the formed toner image is transferred by a transfer device to a recording medium to form an image on a recording material.

In the prior art, many manufacturers use a stretchable driving force receiving apparatuses. a control mechanism for controlling the driving force receiving apparatus to extend and retract is arranged on one side of the process cartridge so that the driving force receiving apparatus is engaged with a driving head in the imaging device during the work of the process cartridge, and the driving force receiving apparatus is disengaged from the driving head during detachment of the process cartridge. For example, Chinese Patent Publication No. CN102385300A discloses a control mechanism, including a control lever that can rotate around a fulcrum provided on the housing of process cartridge and a spring for controlling the control lever to rotate. The control mechanism can control a driving force receiving member on the process cartridge to extend and retract to achieve the engagement with and disengagement from a mechanical driving device. By adoption of such structure, when the size of the process cartridge is further limited so that the retraction stroke of the driving force receiving member is restricted, the driving force receiving member cannot be completely disengaged from the driving head in the imaging device, resulting in difficulty to take out the process cartridge from the imaging device.

In addition, Chinese Patent Publication No. CN105843008A discloses a driving force receiving component of a photosensitive drum. The installation angle of the driving force receiving member in the imaging device is adjusted by the combination of a position adjusting apparatus and a rotating apparatus, the disengagement of the driving force receiving member and the driving head in the imaging device via a swing of the driving force receiving member toward the two sides. As the driving force receiving member cannot swing within 360 degrees, the driving force receiving member cannot normally swing to achieve the disengagement at some angles. Meanwhile the driving force receiving member may also swing in a driving force transmission process, resulting in instable driving force transmission.

All references cited herein are incorporated herein by reference in their entireties.

BRIEF SUMMARY OF THE INVENTION

Benefits of the invention include a process cartridge for solving the technical problem in the prior art that, when the size of the process cartridge is limited, a driving force receiving member in the process cartridge cannot normally engage with or disengage from a driving head in an imaging device.

In order to solve the above technical problem, the invention may be implemented by the following technical solutions: a process cartridge detachably installed in an imaging device with a rotatable driving head and an openable and closable machine door cover along an installation direction, the process cartridge including a housing, a driving force receiving member capable of receiving a force of the driving head, and a rotatable component rotatably supported by the housing and capable of receiving a force of the driving force receiving member to rotate; the process cartridge being installed in the imaging device along a direction approximately perpendicular to the axis direction of the rotatable component, wherein the driving force receiving member has a first state and a second state relative to the driving head. The first state is a state in which the driving force receiving member abuts against the driving head after the process cartridge is installed in the imaging device and the machine door cover is closed. The abutting state refers to a state in which the axis of the driving force receiving member is not coaxial with the axis of the driving head. The second state is a state in which the driving force receiving member is engaged with the driving head. The second state refers to that the driving force receiving member and the driving head are approximately coaxial, and the driving force receiving member can receive the driving force from the driving head to rotate the rotatable component. When the driving force receiving member is in the first state relative to the driving head, as the imaging device drives the driving head to rotate, the driving force receiving member can move from the first state to the second state relative to the driving head.

Further, a force receiving part capable of receiving the machine door cover may be further arranged on the housing.

Further, an elastic member may be arranged between the force receiving part and the housing.

Further, in the axis direction of the rotatable component, regardless of if the driving force receiving member is in the first state or the second state relative to the driving head, at least a part of the driving force receiving member may be overlapped with the driving head.

Further, a power output arm may be arranged on the driving head, and when the driving head rotates, the power output arm can apply a force to the driving force receiving member, so that the driving force receiving member moves from the first state to the second state relative to the driving head.

Further, a claw part that can be combined with the power output arm may be arranged on the driving force receiving member, the claw part may be provided with a facing part facing to the axis of the driving force receiving member, and when the driving head rotates, the power output arm can pass over the facing part.

Further, when the driving head rotates, the driving force receiving member can force the driving head to retract in a rotation axis direction thereof.

Further, a power output arm may be arranged on the driving head, a claw part that can be combined with the power output arm may be arranged on the driving force receiving member, and when the driving head rotates, the claw part presses the power output arm so that the driving head retracts in the rotation axis direction thereof.

Further, a pair of claw parts may be arranged on the driving force receiving member, an opening part may be formed between the pair of claw parts, and the process cartridge may be further provided with an adjustment component capable of adjusting the position of the driving force receiving member, so that when the process cartridge is installed in the imaging device, a run-through direction of the opening part may face the driving head.

Further, an auxiliary detachment member may be arranged on the process cartridge, and when the process cartridge is taken out from the imaging device, the auxiliary detachment member can be rotated.

Further, the driving head may be provided with a power output arm, the driving force receiving member is provided with a claw part engageable with the power output arm, and when the process cartridge is installed in the imaging device, and the driving force receiving member abuts against but is not coaxial with the driving head, the power output arm can touch the claw part and drive the driving force receiving member to rotate when the driving head rotates.

The process cartridge may be characterized in that the driving head is provided with a power output arm, the driving force receiving member is provided with a claw part engageable with the power output arm, and the claw part is capable of moving in a direction intersecting with the rotation axis of the driving force receiving member.

After the above solution is adopted, when the driving force receiving member in the process cartridge interferes with the driving head in the imaging device, the driving force receiving member may be driven by the rotation of the driving head to rotate by means of the contact between the driving force receiving member and the driving head so as to overcome the interference state to achieve smooth installation, and meanwhile, the process cartridge may be obliquely taken out to guarantee the process cartridge is taken out smoothly. The technical problem that the driving force receiving member in the process cartridge cannot be normally engaged with and disengaged from the driving head in the imaging device in the prior art is solved.

BRIEF DESCRIPTION OF SEVERAL VIEWS OF THE DRAWING

To illustrate technical solutions in the embodiments of the invention or in the prior art more clearly, a brief introduction on the drawings for use in the description of the embodiments or the prior art is given below. Apparently, the drawings in the description below are merely some of the embodiments of the invention, based on which other drawings can be obtained by those of ordinary skill in the art without any creative effort. Like reference numerals designate like elements and wherein.

DETAILED DESCRIPTION OF THE INVENTION

The embodiments of the invention will be described in detail below with reference to the drawings. It should be understood that the specific embodiments described herein are only used for explaining the invention rather than limiting the invention.

First Embodiment

Figure 1:
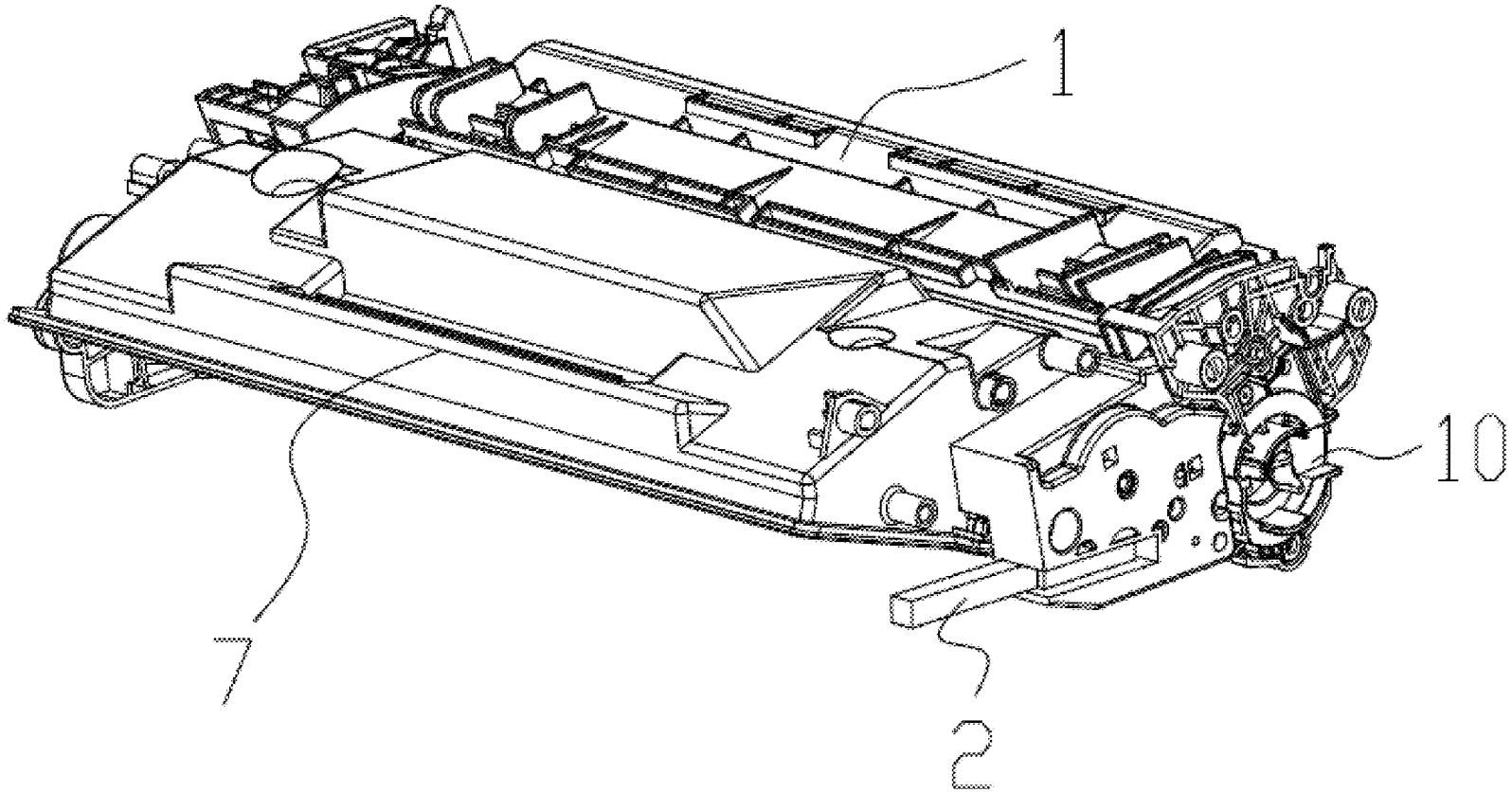
FIG. 1 is a structural schematic diagram of a process cartridge provided by the invention.

As may be seen in FIG. 1, a process cartridge of the invention includes a housing 1 provided with a developer accommodating part, a handle 7 arranged at a back end of the housing, a rotating member (not shown in the figure) arranged at a front end of the housing 1, and a driving component 10 arranged on a lateral end of the housing 1, wherein the rotating member can be a photosensitive drum, a developing roller or the like, and the driving component 10 can receive a driving force from an imaging device and force the rotating member to rotate. The process cartridge is further provided with a force receiving part 2 arranged on the same side as the driving component 10.

Figure 2:
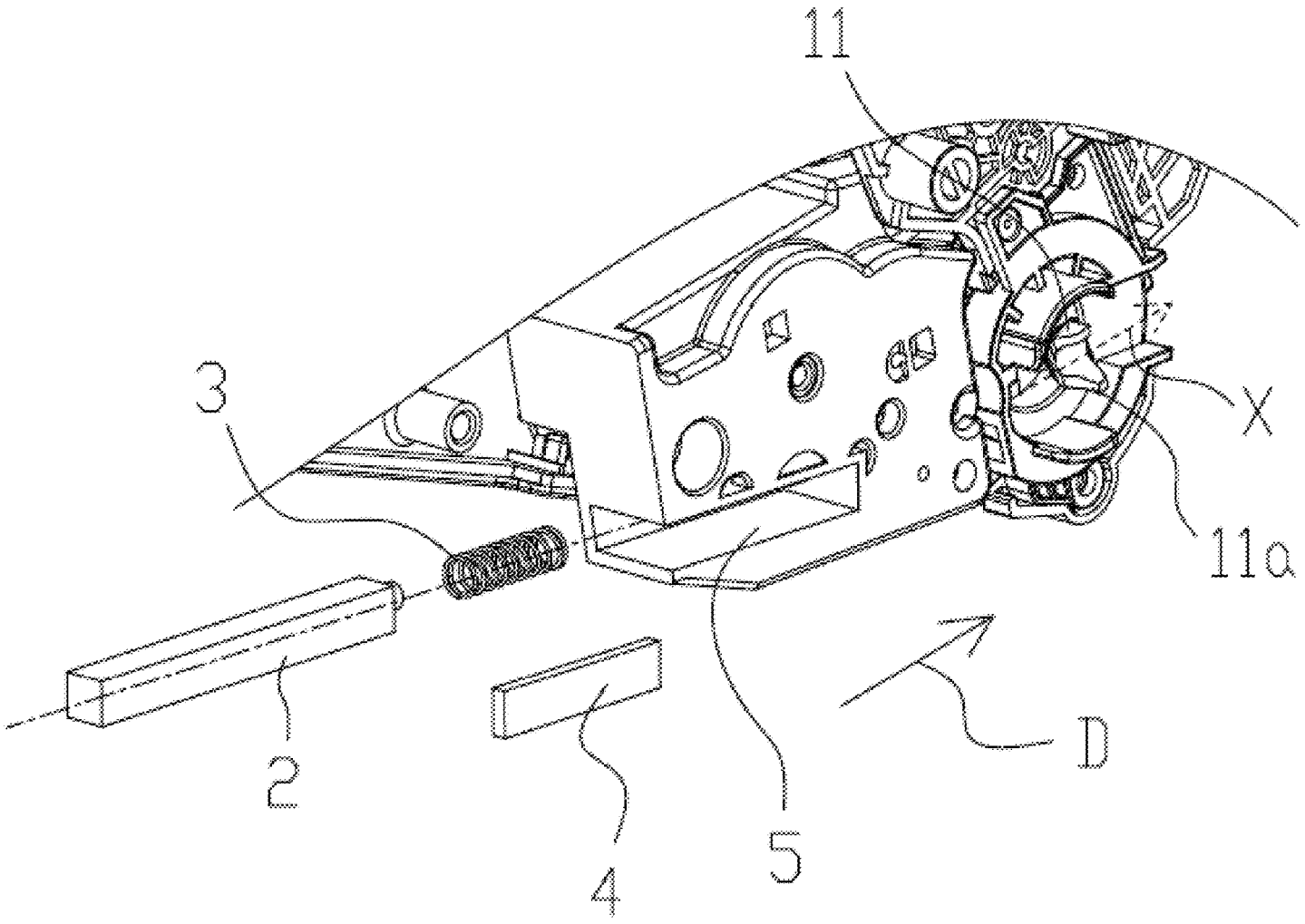
FIG. 2 is an exploded structure diagram of a process cartridge provided by the invention on the side of a force receiving part.

As shown in FIG. 2, which is an exploded structure diagram of the process cartridge provided by the invention on the side of the force receiving part 2, a mounting part 5 is arranged on the housing 1, one end of a first elastic member 3 abuts against the mounting part 5, the other end of the first elastic member 3 abuts against the force receiving part 2, and a cover plate 4 covers the force receiving part 2 and the first elastic member 3 to prevent the force receiving part 2 and the first elastic member 3 from dropping. The driving component 10 includes a driving force receiving member 11 that is provided with a pair of claw parts 11*a* protruding along a rotation axis direction of the driving force receiving member.

Figure 3:
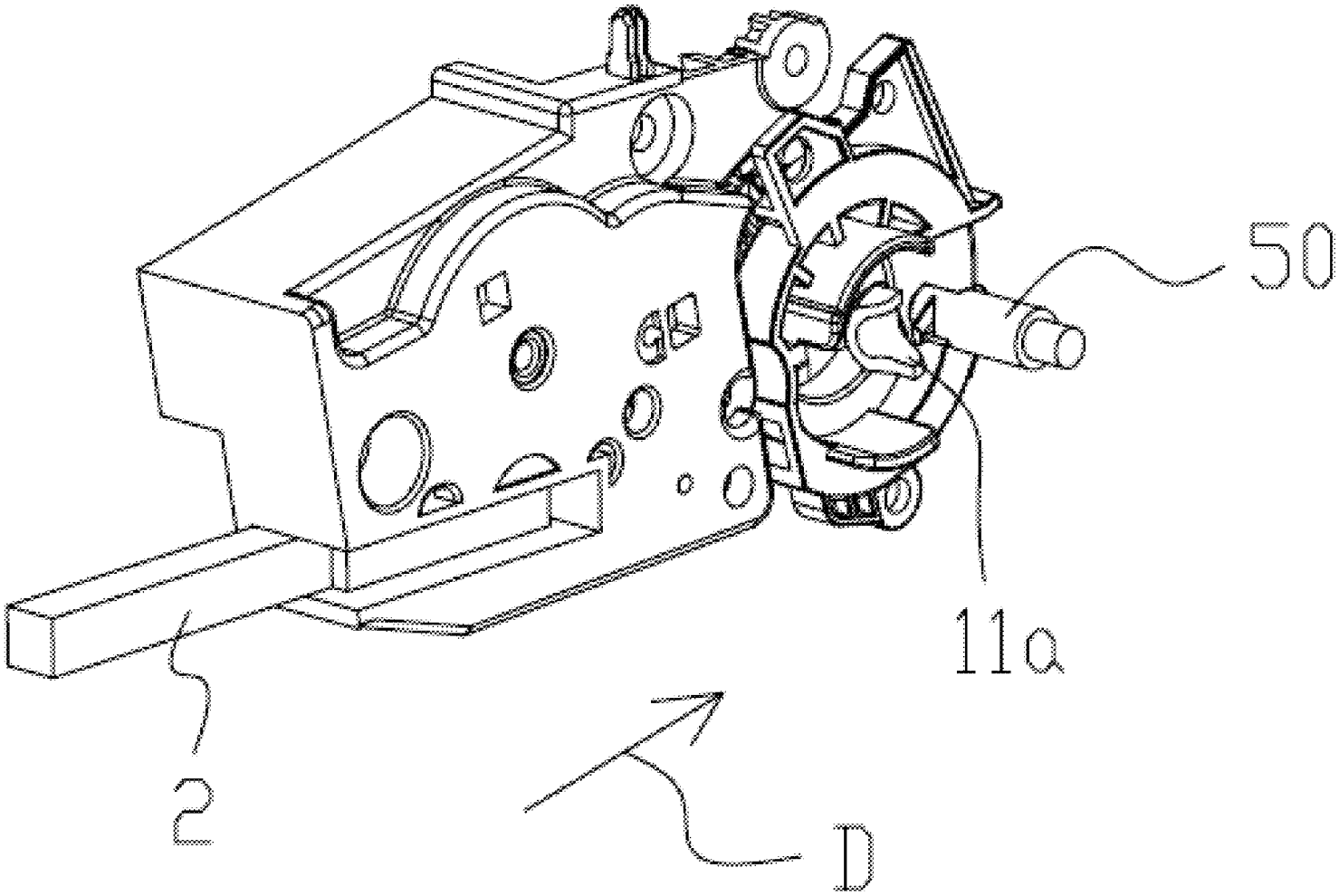
FIG. 3 is a structural schematic diagram of a first state in which a process cartridge provided by the invention is installed in an imaging device.
Figure 4:
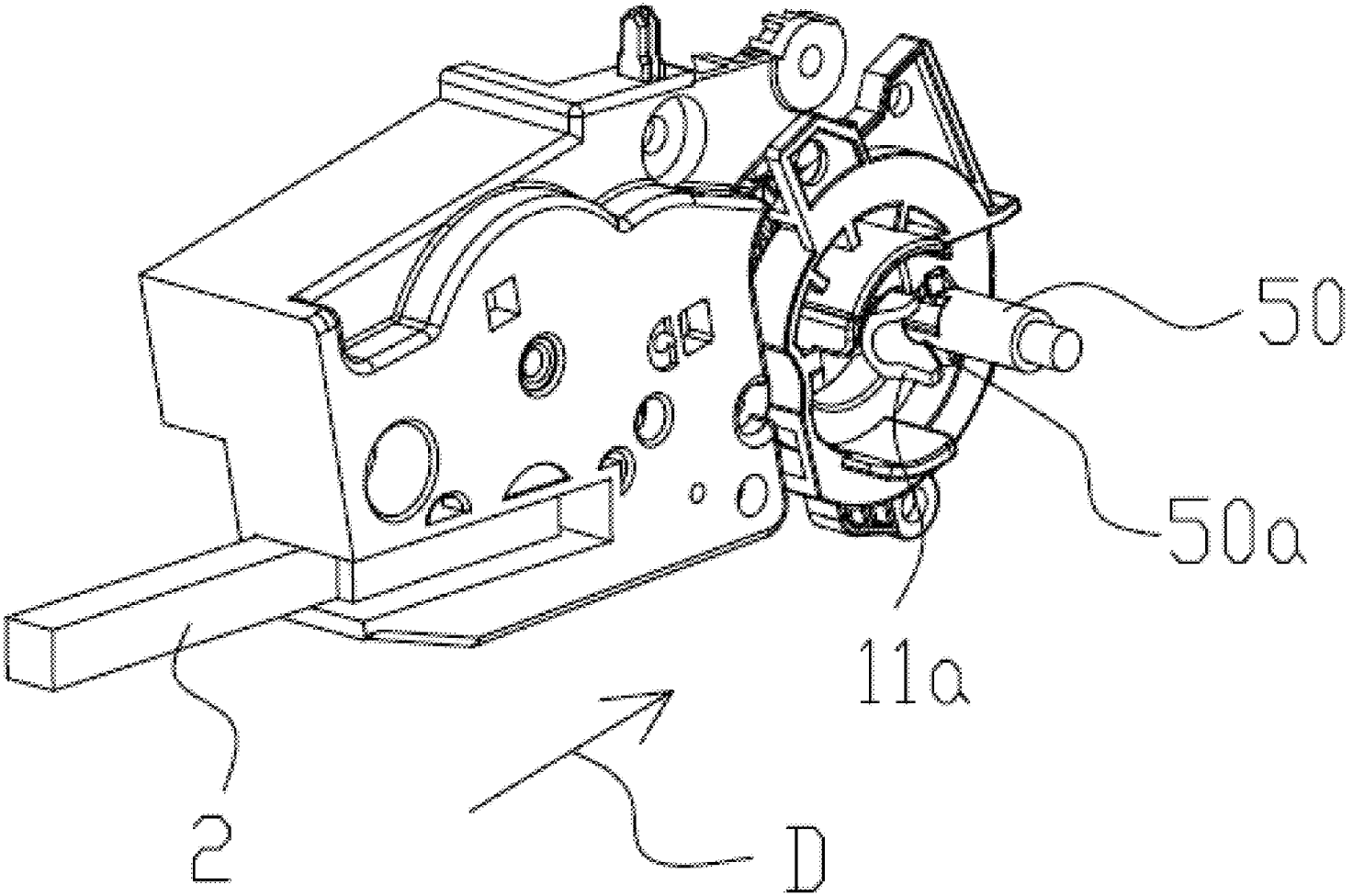
FIG. 4 is a structural schematic diagram of a second state in which a process cartridge provided by the invention is installed in an imaging device.

As may be seen in FIGS. 2 to 4, a driving head 50 in the imaging device includes a pair of power output arms 50*a*. When the process cartridge is installed in the imaging device along the direction of an arrow D in the figures, the driving force receiving member 11 may have two states relative to the driving head 50. The first state is shown in FIG. 3, which shows a position when an X face of a run-through direction of an opening formed between the pair of claw parts 11*a* faces to the driving head, and the power output arm 50*a* of the driving head 50 stays at a position where it does not interfere with the claw parts 11*a*, at this time, the driving force receiving member 11 can directly penetrate through the driving head 50 and stay at a position coaxial with the driving head 50. After a machine door cover of the imaging device is closed, the imaging device drives the driving head 50 to rotate and engage with the driving force receiving member 11 to drive the driving force receiving member to rotate. That is to say, the first state refers to a state in which the driving force receiving member 11 does not interfere with the driving head 50 in the imaging device in an installation process of the process cartridge.

The second state is shown in FIG. 4. In this state, the claw part 11*a* of the driving force receiving member 11 interferes with the driving head 50, at this time, the machine door cover of the imaging device is closed, and the machine door cover presses the force receiving part 2 to keep the contact between the driving force receiving member 11 and the driving head 50. When the imaging device drives the driving head 50 to rotate, the power output arm 50*a* of the driving head 50 will contact the claw part 11*a* of the driving force receiving member 11 and cause the driving force receiving member 11 to rotate a certain angle. When the driving force receiving member 11 rotates to the position as shown in FIG. 3, and meanwhile the driving head 50 also rotates to the position as shown in FIG. 3, the driving force receiving member 11 penetrates through the driving head 50 and stays at a position coaxial with the driving head 50, and then engages with the driving head 50 to receive the driving force. Alternatively, the force receiving part 2 can also receive a force from other position except the machine door cover in the imaging device to keep the contact of the driving force receiving member 11 and the driving head 50.

In addition, the force receiving part 2 can also be fixedly arranged on the housing 1, and the force receiving part 2 can receive a force from an elastic mechanism in the imaging device to keep the contact of the driving force receiving member 11 and the driving head 50. In some imaging devices, the installation direction of the process cartridge in the imaging device is obliquely downward along the gravity direction, and in this state, the process cartridge may be not provided with the force receiving part 2, and the contact between the driving force receiving member 11 and the driving head 50 can be achieved through the gravity of the process cartridge.

Figure 5:
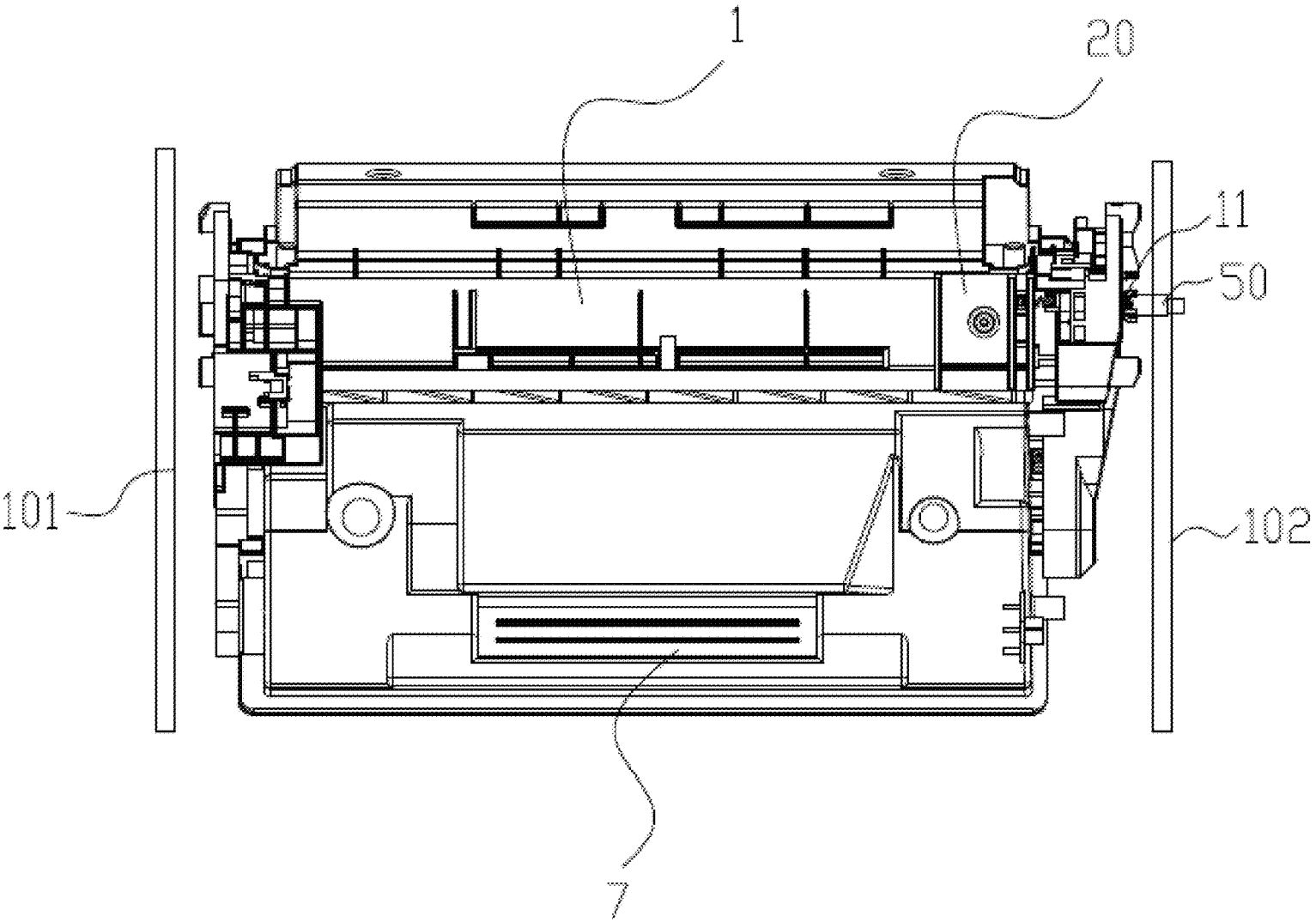
FIG. 5 is a structural schematic diagram of a first state in which a process cartridge provided by the invention is taken out from an imaging device.
Figure 6:
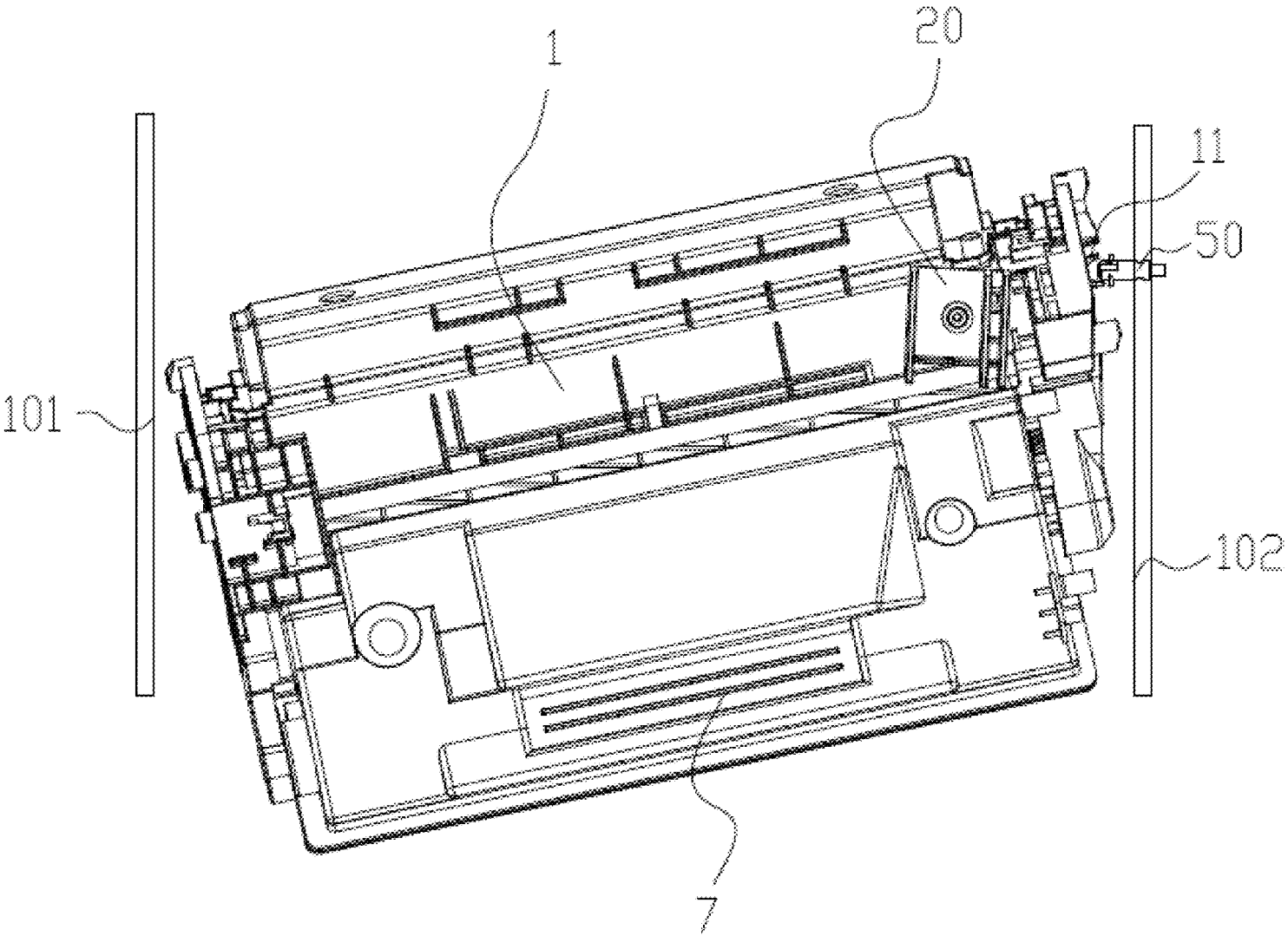
FIG. 6 is a structural schematic diagram of a second state in which a process cartridge provided by the invention is taken out from an imaging device.
Figure 7:
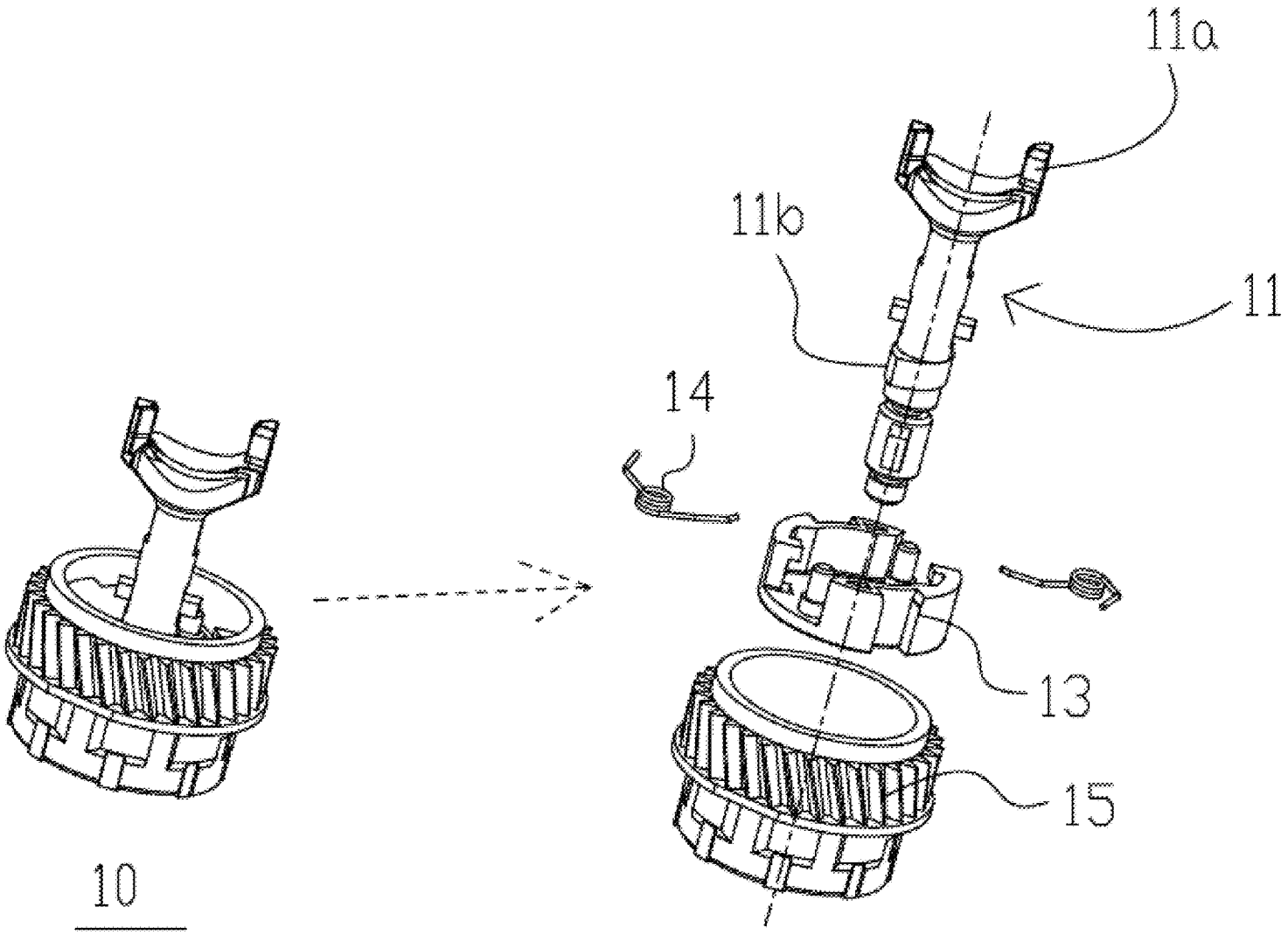
FIG. 7 is a partial structure diagram of a driving component in a second embodiment of a process cartridge provided by the invention.

As may be seen in FIGS. 5 and 6, the imaging device is provided with a left side plate 101 and a right side plate 102, the process cartridge is supported between the left side plate 101 and the right side plate 102, and the housing 1 of the process cartridge can obliquely move between the left side plate 101 and the right side plate 102. When the process cartridge needs to be taken out, the machine door cover in the imaging device is opened, and the handle 7 is held to pull the process cartridge outward, and as the driving force receiving member 11 is engaged with the driving head 50 at the moment, the process cartridge uses a combination point of the driving force receiving member 11 and the driving head 50 as a fulcrum, and the process cartridge rotates around the combination point to be smoothly taken out in an oblique posture.

Second Embodiment

A second embodiment of the process cartridge provided by the invention is described below. The second embodiment of the invention differs from the first embodiment only in that an adjustment mechanism is added to adjust the cooperation position between the driving force receiving member 11 and the driving head 50.

As may be seen in FIG. 5, the driving component 10 in the second embodiment of the invention is provided with an adjusted part 11*b* with an elliptic cross section on the driving force receiving member 11, a flange 15 is used for receiving the driving force of the driving force receiving member 11 and transferring the driving force into a rotatable component in the process cartridge. An adjustment component locating member 13 is further arranged in the vicinity of the driving force receiving member 11. The adjustment component locating member 13 can cooperate with the housing of the process cartridge to prevent it rotating with the driving force receiving member 11.

An adjustment component 14 is installed in the adjustment component locating member 13. The adjustment component 14 is set as a torsional spring in the present embodiment. One end of the torsional spring abuts against the adjustment component locating member 13. The other end of the torsional spring abuts against the adjusted part 11*b* on the driving force receiving member 11. Meanwhile the driving force receiving member 11 is configured to have a certain free gap relative to the flange 15 in the rotation direction. The adjustment component 14 can adjust the position of the driving force receiving member 11 to the state as shown in FIG. 3 through the cooperation with the adjusted part 11*b*, then it can be guaranteed that every time when the process cartridge is installed in the imaging device along the installation direction D.

The process cartridge is installed in a posture where a run-through direction of the opening part formed between the pair of claw parts 11*a* faces to the driving head 50. Such setting can reduce the interference possibility of the driving force receiving member 11 and the driving head 50 when the process cartridge is installed in the imaging device, and meanwhile can also reduce the angle that the driving force receiving member 11 needs to be rotated by the driving head 50. Therefore the installation of the process cartridge can be smoother, and meanwhile the service life of the driving head 50 can be prolonged.

Third Embodiment

A third embodiment of the process cartridge provided by the invention is described below. The third embodiment of the invention differs from the second embodiment in that when the driving force receiving member of the process cartridge is in contact with the driving head in the imaging device, the driving force receiving member of the process cartridge also has a space for motion, so that when the driving head rotates, the power output arm of the driving head can stretch into the space between the pair of claw parts of the driving force receiving member.

Figure 8:
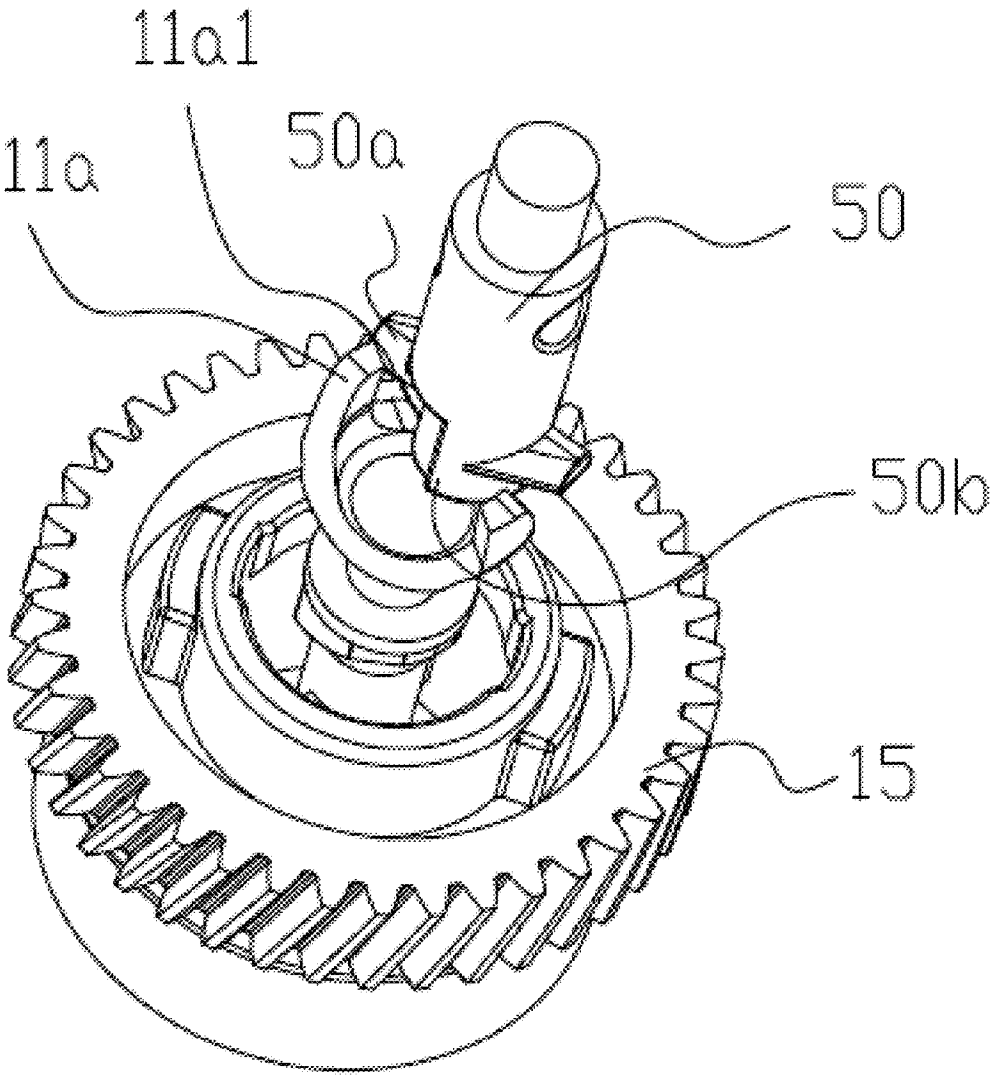
FIG. 8 is a structural schematic diagram of a first state in which a driving component in a third embodiment of a process cartridge provided by the invention is pre-engaged with a driving head.
Figure 9:
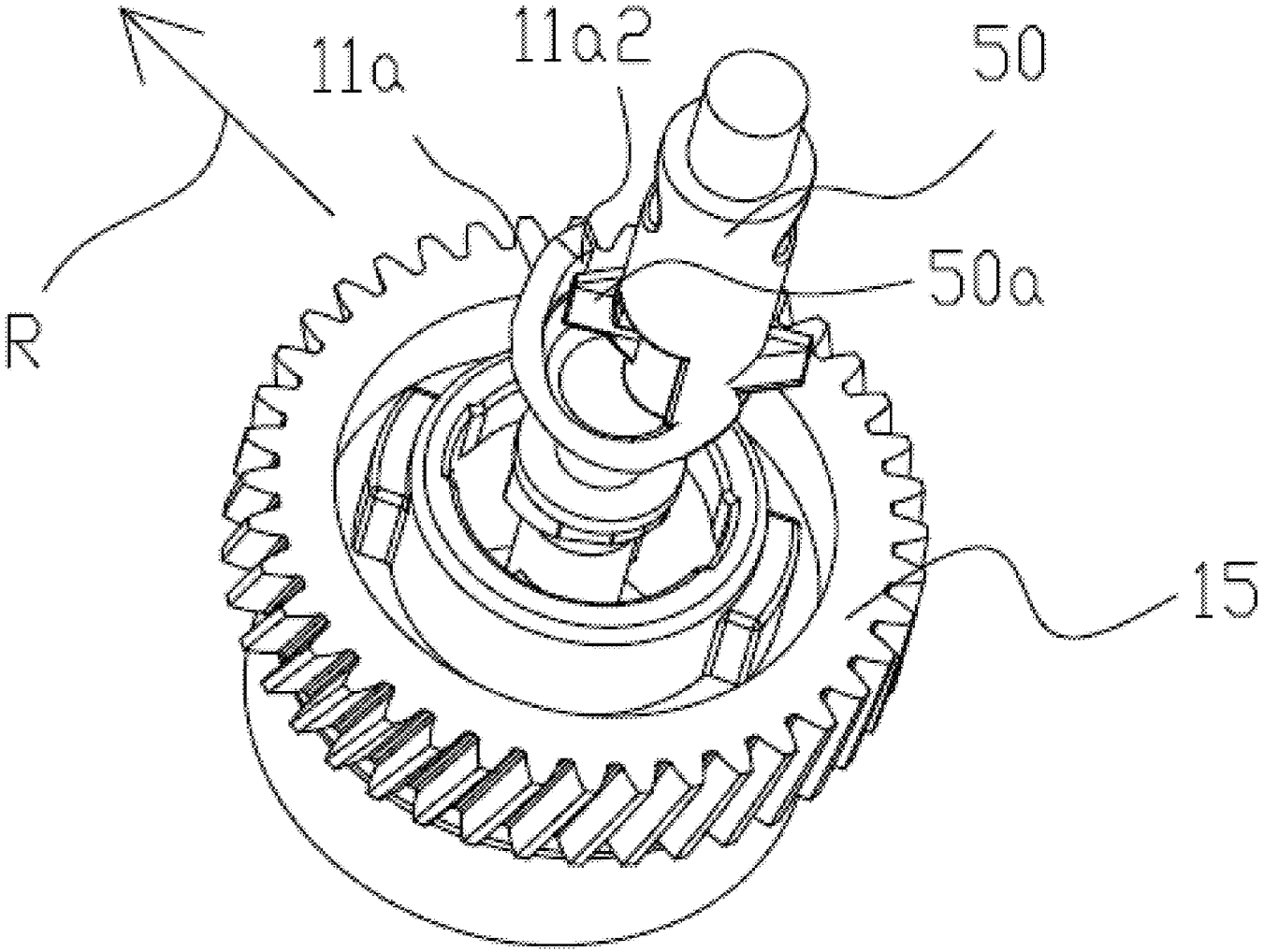
FIG. 9 is a structural schematic diagram of a second state in which the driving component in the third embodiment of the process cartridge provided by the invention is pre-engaged with the driving head.
Figure 10:
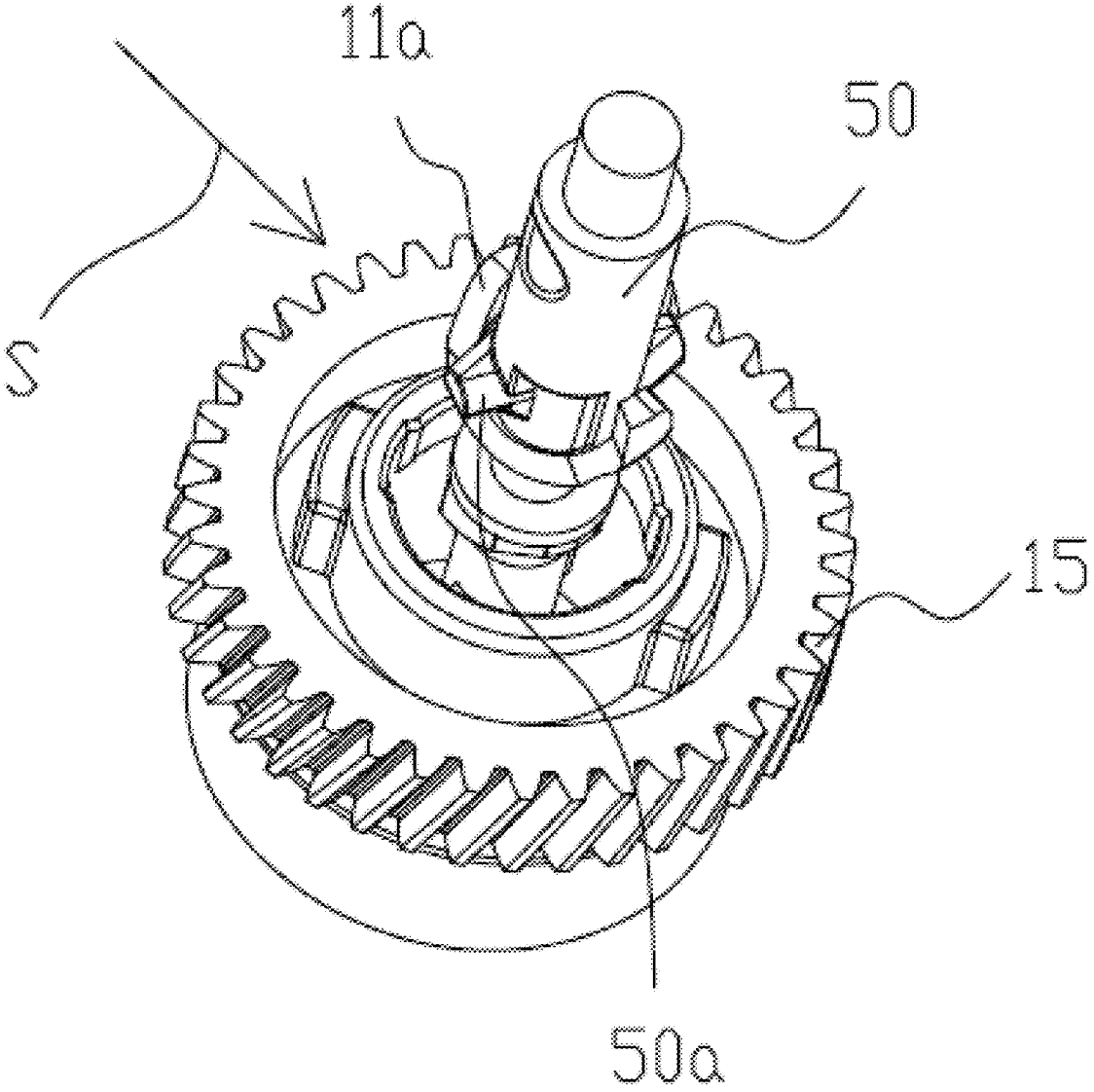
FIG. 10 is a structural schematic diagram when the driving component in the third embodiment of the process cartridge provided by the invention is engaged with the driving head.

Specifically, as may be seen in FIGS. 8 to 10, the claw part 11*a* has a facing part 11*a*2 facing the rotation axis of the driving force receiving member 11 and a side face 11*a*1 adjoined with the facing part 11*a*2. The driving head 50 further includes a front end column body part 50*b* arranged at the lower end of the power output arm 50*a*. In the present embodiment, the pre-engagement state between the driving force receiving member 11 and the driving head 50 is the same as that in the second embodiment. That is, a part of the front end column body part 50*b* of the driving head 50 firstly stretches into the gap formed between the pair of claw parts 11*a*, and then the power output arm 50*a* touches the side faces 11*a*1 of the claw parts 11*a*.

In the present embodiment, after the machine door cover of the printer is closed, the printer drives the driving head 50 to rotate, as the driving force receiver member is set as to have a space for motion. The power output arm 50*a* of the driving head 50 will force the claw parts 11*a* of the driving force receiving member to move along the direction of an arrow R in the figure. The direction of the arrow R is a direction the claw parts 11*a* moves away from the axis along a direction perpendicular to the axis of the driving force receiving member. Then the power output arm 50*a* stretches into the gap formed between the pair of claw parts 11*a* and touches the facing parts 11*a*2. With the further rotation of the driving head 50, the power output arm 50*a* slides over the facing parts 11*a*2, the claw parts 11*a* move along a S direction opposite to the R direction as shown in the figure, and finally, the driving force receiving member 11 and the driving head 50 come into a normal engagement state as shown in FIG. 10. The normal engagement state refers to a state in which the driving force receiving member 11 is approximately coaxial with the driving head 50.

Fourth Embodiment

A fourth embodiment of the process cartridge provided by the invention is described below. As may be seen in FIGS. 11 to 13, the embodiment differs from the first embodiment in that when the driving force receiving member 11 and the driving head 50 are in the pre-engagement state and are in contact each other, after the driving head 50 rotates, the driving force receiving member 11 is not driven by the driving head 50 to rotate. Instead, the driving head 50 moves in the axis direction so that the driving force receiving member 11 is engaged with the driving head 50. Specifically, in the present embodiment, as may be seen in FIG. 11, the driving head 50 of the imaging device is set to elastically move, a second elastic component 51 is arranged between the driving head 50 and the inner wall of the imaging device and the second elastic component 51 causes the driving head 50 to perform telescopic movement in its rotation axis direction.

Figure 11:
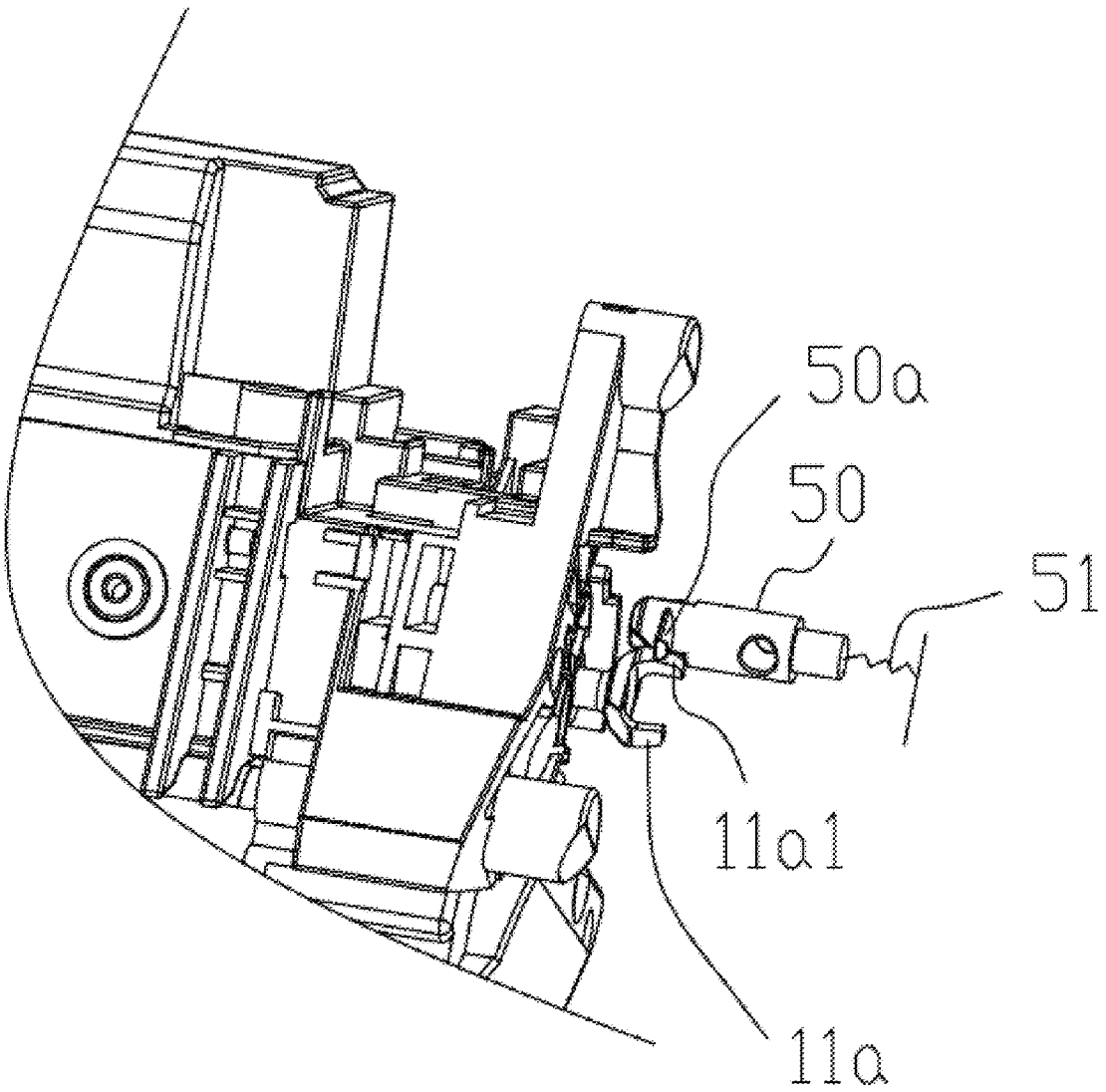
FIG. 11 is a structural schematic diagram of a first state in which a driving force receiving member in a fourth embodiment of a process cartridge provided by the invention is pre-engaged with a driving head.
Figure 12:
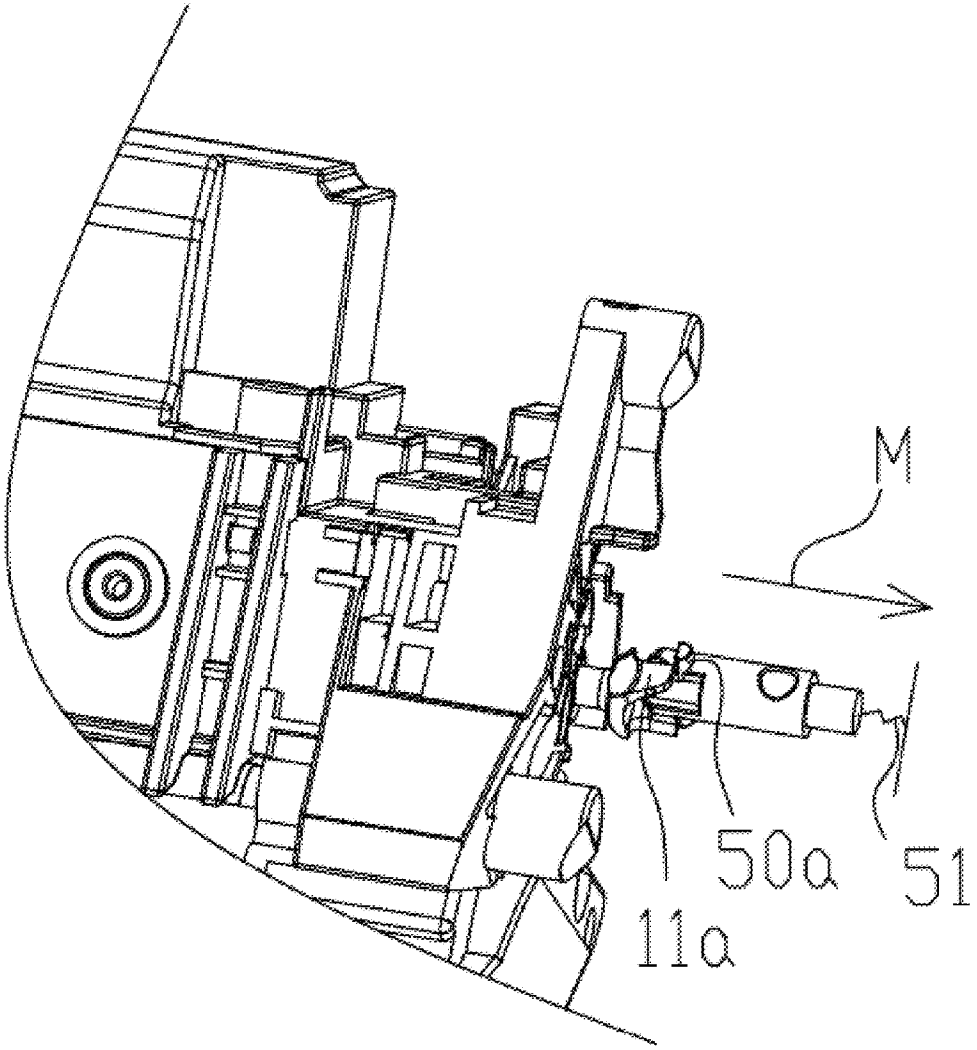
FIG. 12 is a structural schematic diagram of a second state in which the driving force receiving member in the fourth embodiment of the process cartridge provided by the invention is pre-engaged with the driving head.

After the machine door cover of the printer is closed, the driving head 50 starts rotating, and as one side face 11*a*1 of the claw part 11*a* of the driving force receiving member 11 abuts against the power output arm 50*a* of the driving head 50. The driving head 50 can overcome the elastic force of the second elastic component 51 to move along the direction of an arrow M in the figure. The M direction is the rotation axis direction of the driving head 50, and the M direction is a direction away from the claw part 11*a*. With the retraction of the driving head 50, the power output arm 50*a* finally retracts to a position departing from one side face 11*a*1 of the claw part 11*a* (FIG. 11).

Figure 13:
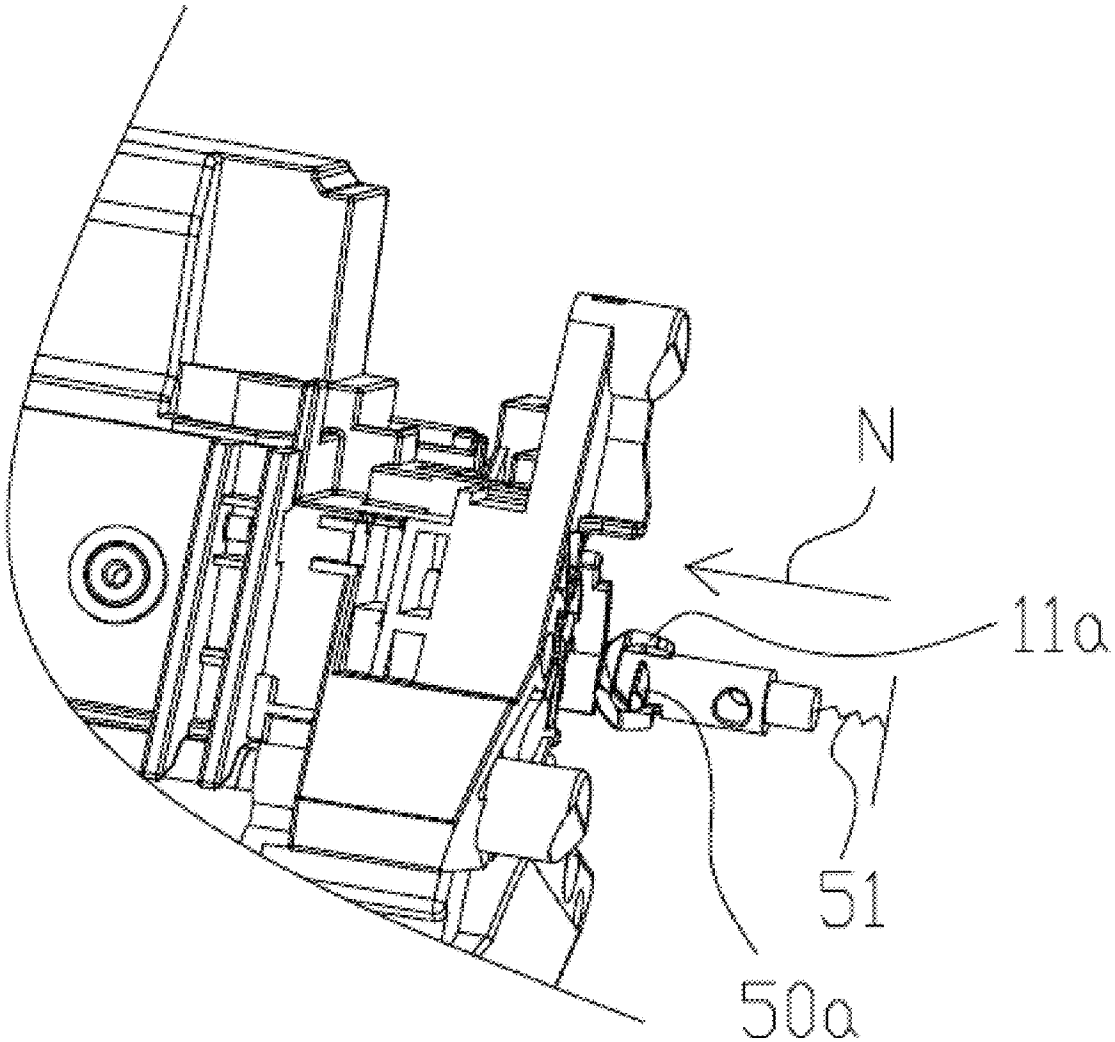
FIG. 13 is a structural schematic diagram when the driving force receiving member in the fourth embodiment of the process cartridge provided by the invention is engaged with the driving head.

The departing position refers to a position where the power output arm 50*a* is not in contact with the side face 11*a*1 of the claw part 11*a* in the axis direction of the driving force receiving member 11 and is not blocked by the side face 11*a*1. In this position, the power output arm 50*a* of the driving head 50 crosses over the claw part 11*a* from the top end of the claw part 11*a*, and after the power output arm 50*a* crosses over the claw part 11*am*, the elastic force of the second elastic component 51 pushes the driving head 50 to extend out along the axial direction toward a direction close to the claw part 11*a*. Finally the driving force receiving member 11 and the driving head 50 enter the normal engagement state as shown in FIG. 13. The normal engagement state refers to a position where the driving force receiving member 11 is approximately coaxial with the driving head 50.

Fifth Embodiment

Figure 14:
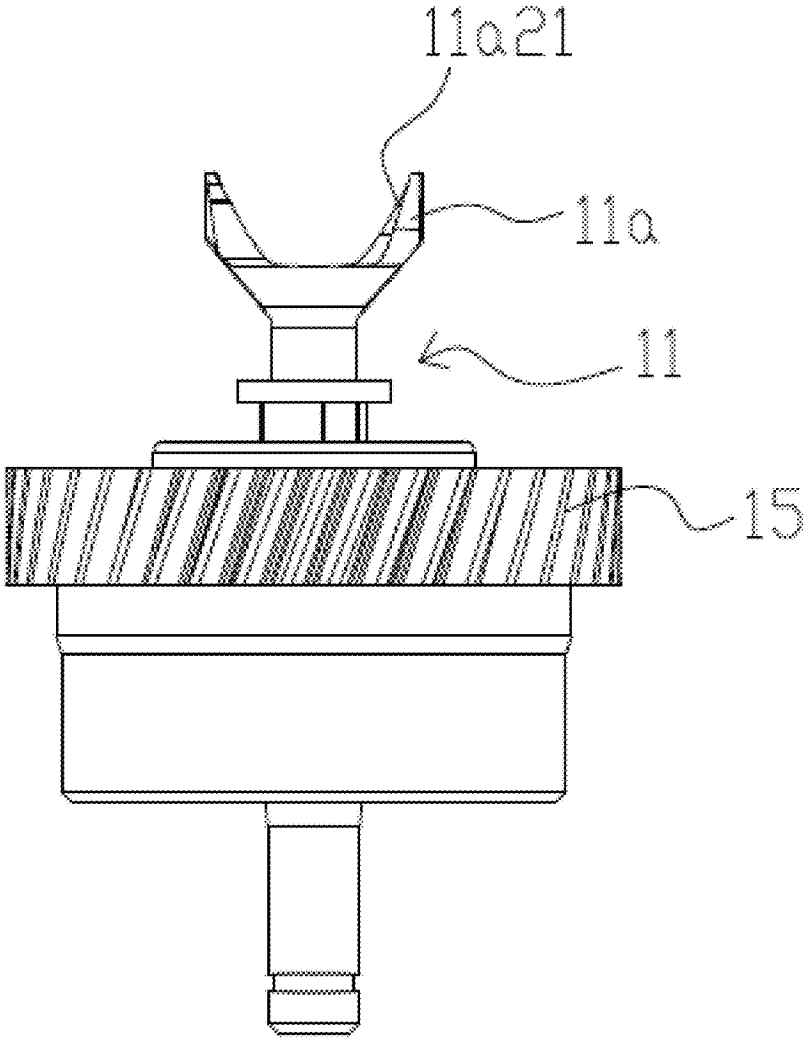
FIG. 14 is a partial structure diagram of a driving component in a fifth embodiment of a process cartridge provided by the invention.

A fifth embodiment of the process cartridge provided by the invention is described below. The embodiment differs from the first embodiment to the fourth embodiment in that the local shape of the claw part 11*a* of the driving force receiving member 11 is changed. As may be seen in FIG. 14, in the present embodiment, on the claw part 11*a* of the driving force receiving member 11, a facing part 11*a*21 facing to the axis of the driving force receiving member 11 is set as an outward extending conical shape. In other words, in measured along a direction perpendicular to the axial direction of the driving force receiving member 11, the distance between the facing part 11*a*21 and the axis of the driving force receiving member 11 continuously increases with the increase of the distance between the facing part 11*a*21 and the flange 15 in the axis direction. Such setting can enable the power output arm 50*a* of the driving head 50 to more flexibly stretch into the gap formed between the pair of claw parts 11*a*, so that the driving force receiving member 11 and the driving head 50 can enter the engagement state from the pre-engagement state more flexibly and conveniently.

Sixth Embodiment

Figure 15:
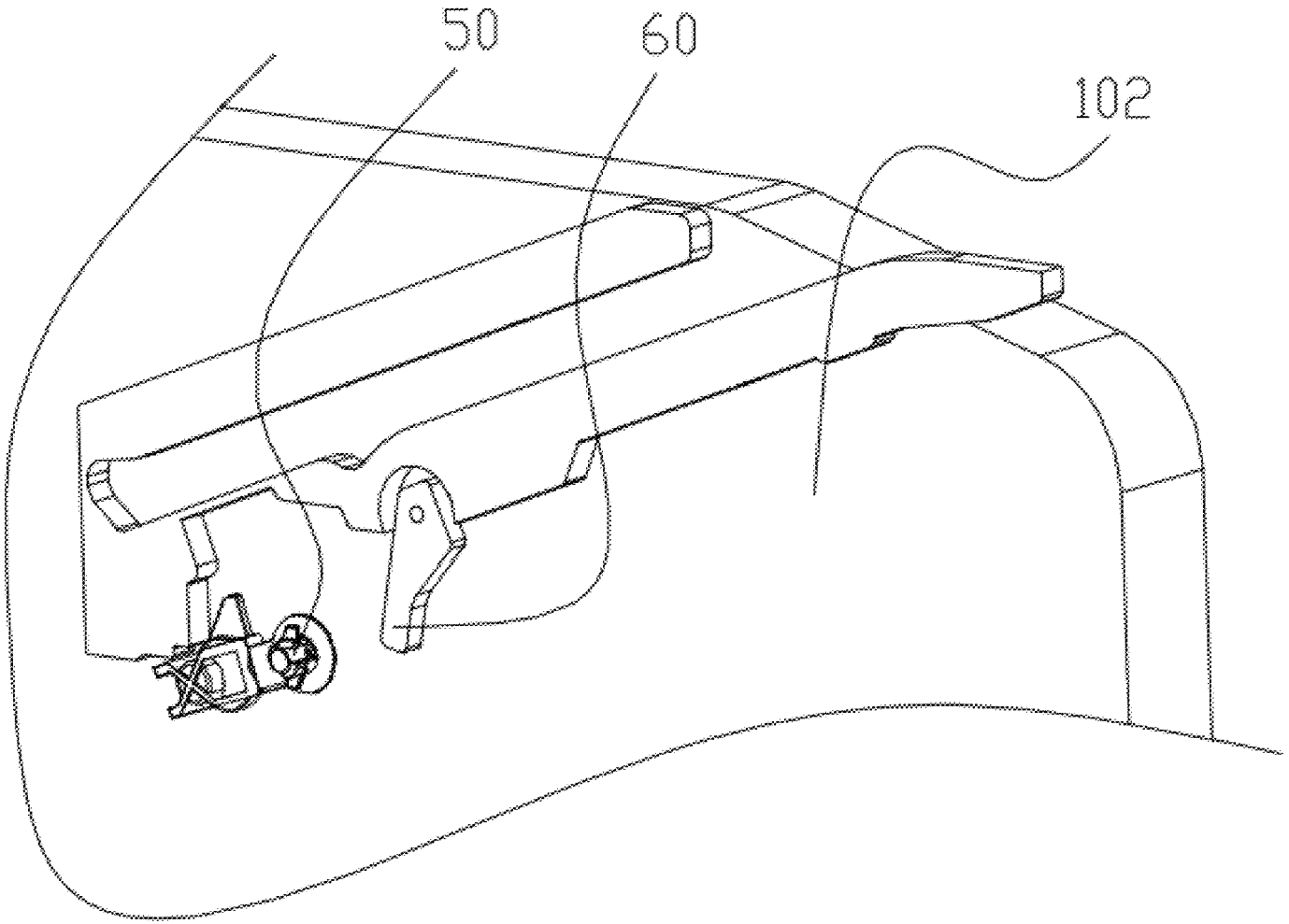
FIG. 15 is a partial structure diagram of a right side wall of an existing imaging device.

A sixth embodiment of the process cartridge provided by the invention is described below. As may be seen in FIG. 15, in some existing imaging devices a blocking component 60 is arranged on the right side plate 102 where the driving head

50 is located. The blocking component 60 is rotatably arranged on the right side plate 102, and a locking component (not shown in the figure) that locks the blocking component 60 to prevent the same from rotating is further arranged on a top plate (not shown in the figure) in the vicinity of the right side plate 102. When the process cartridge is installed along the right side plate 102, the locking component arranged on the right side plate 102 needs to be unlocked at first, so that the blocking component 60 restores the rotation to continue the installation. The locking component is a convex structure installed in a recess in the top plate of the imaging device.

Figure 16:
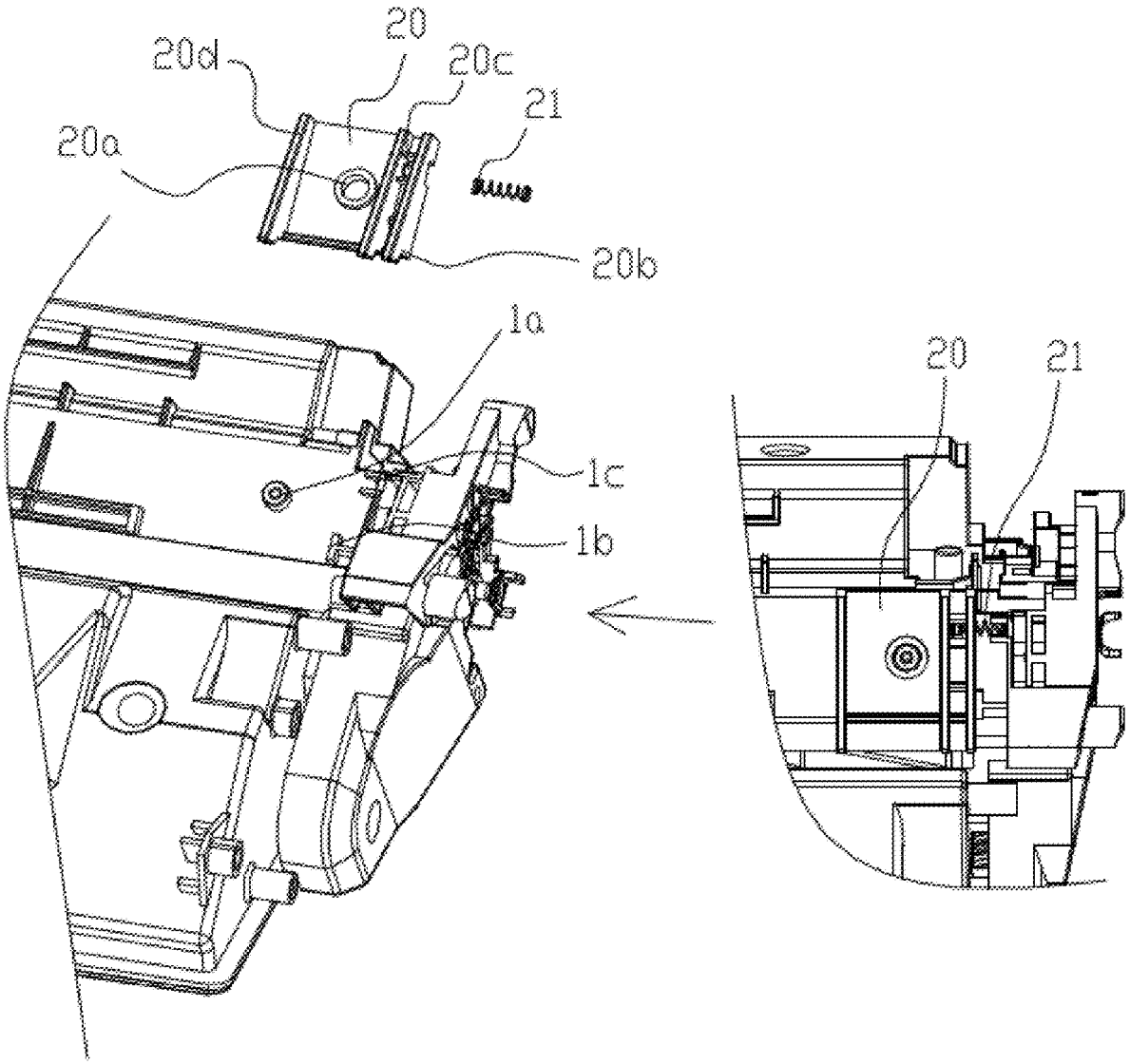
FIG. 16 is a partial structure diagram of a movable auxiliary detachment member arranged on a process cartridge in a sixth embodiment of a process cartridge provided by the invention.

Since the process cartridge in the present embodiment needs to be tilted when being taken out from the imaging device, an auxiliary detachment member 20 is provided on the process cartridge. As may be seen in FIG. 16, in the present embodiment, an auxiliary detachment member mounting part 1*a* is arranged on the housing of the process cartridge. A through hole 20*a* is formed in the auxiliary detachment member 20. The through hole 20*a* is installed in the auxiliary detachment member mounting part 1*a* and is rotatable. A third elastic component 21 is arranged between the auxiliary detachment member 20 and the housing 1. One end of the third elastic component 21 abuts against a first end abutting part 1*c* on the housing, and the other end of the third elastic component 21 abuts against a second end abutting part 20*c* of the auxiliary detachment member 20. A limiting part 1*b* is further arranged on the housing for contact a limited part 20*b* on the auxiliary detachment member 20 to limit the position of the auxiliary detachment member 20.

When the process cartridge is initially installed in the imaging device, the auxiliary detachment member 20 is limited at an initial position under the action of both the third elastic component 21 and the limiting part 1*b* on the housing. Due to the initial position, when the process cartridge is installed in the imaging device, a locking component push part 20*d* arranged on the auxiliary detachment member 20 can slide into a projection structure arranged in the groove in the top plate of the imaging device to unlock the locking component in the imaging device so that the blocking component 60 restores the rotation function, and the process cartridge pushes the blocking component 60 to rotate to complete the installation.

When the process cartridge needs to be taken out, the auxiliary detachment member 20 can overcome the elastic force of the third elastic component 21 as shown in FIG. 6 to rotate, so that even if the process cartridge is in an oblique state, the auxiliary detachment member 20 does not get rid of the contact with the locking component in the imaging device so as to take out the process cartridge smoothly. When the process cartridge is completely taken out from the imaging device, the auxiliary detachment member 20 is limited at the initial position again under the action of both the elastic component 21 and the limiting part 1*b* on the housing to facilitate the next installation.

Seventh Embodiment

Figure 17:
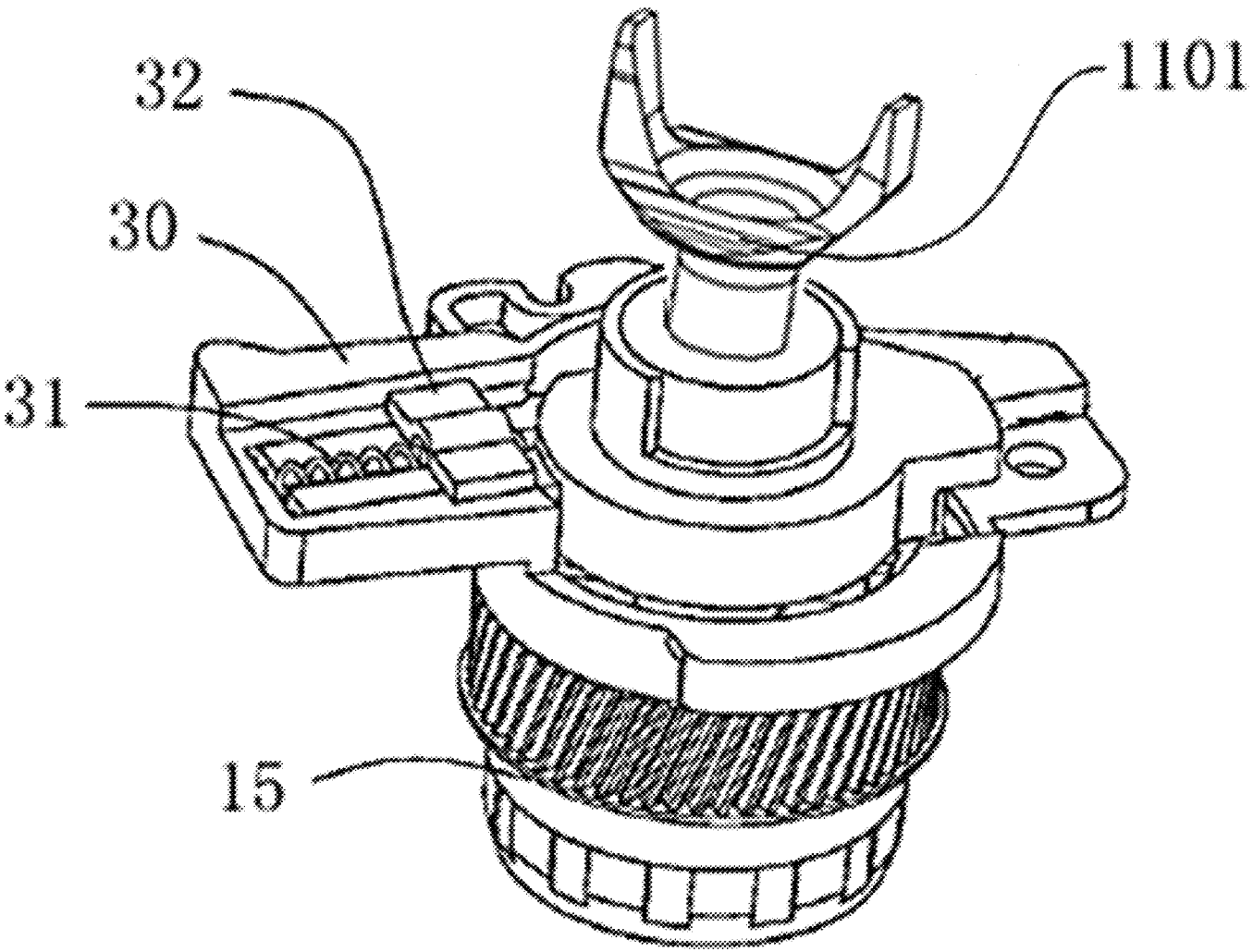
FIG. 17 is a partial structure diagram of a driving component in a seventh embodiment of a process cartridge provided by the invention.
Figure 18:
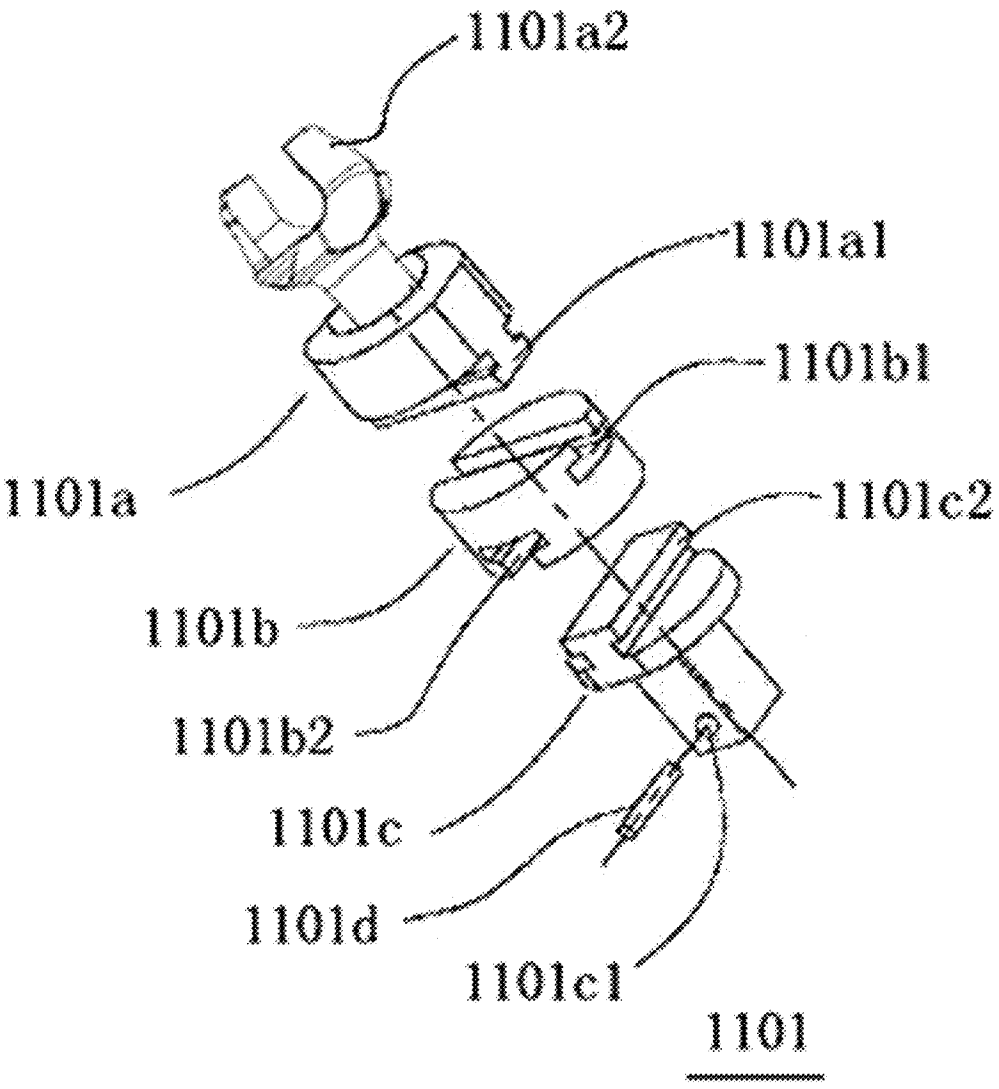
FIG. 18 is a partial exploded structure diagram of the driving component in the seventh embodiment of the process cartridge provided by the invention.

A seventh embodiment of the process cartridge provided by the invention is described below. As may be seen in FIGS. 17 and 18, the present embodiment differs from the first embodiment in that the force receiving part in the first embodiment is omitted in the present embodiment, and the driving force receiving member in the present embodiment is configured to be movable in a direction perpendicular to its rotation axis. In the present embodiment, a fourth elastic member 31 is arranged on a bracket 30 supporting the driving force receiving member 1101. One end of the fourth elastic member 31 abuts against the bracket 31, the other end of the fourth elastic member 31 abuts against the driving force receiving member 1101. A cover plate 32 covers the fourth elastic member 31 to prevent the fourth elastic member 31 from dropping.

In order to achieve movement of the driving force receiving member 1101 in a direction perpendicular to its axis direction, the driving force receiving member is set preferably as a power receiving portion 1101*a*, a power transmission portion 1101*c* and a middle connecting portion 1101*b*. A claw part 1101*a*2 and a first sliding projection 1101*a*1 are arranged on the power receiving portion 1101*a*. A first guiding chute 1101*b*1 and a second guiding chute 1101*b*2 are formed in the middle connecting portion 1101*b*, a second sliding projection 1101*c*2 and a shaft pin mounting hole 1101*c*1 are formed in the power transmission portion 1101*c*, a pin shaft 1101*d* is installed in the shaft pin mounting hole 1101*c*1. The pin shaft 1101*d* can transfer the driving force of the power transmission portion 1101*c* to the flange 15. The power transmission portion 1101*c* is installed in the flange 15 and is fixed relative to the flange 15. The first sliding projection 1101*a*1 and the first guiding chute 1101*b*1 cooperate and can slide relatively. The second sliding projection 1101*c*2 and the second guiding chute 1101*b*2 cooperate and can slide relatively. The extension directions of the first guiding chute 1101*b*1 and the second guiding chute 1101*b*2 intersect with each other, preferably at 90 degrees. Such setting can enable the driving force receiving member 110*a* to freely move in a direction perpendicular to the rotation axis of the driving force receiving member 1101 relative to the power transmission portion 1101*c* without direction limitation.

In the present embodiment, the fourth elastic member 31 is used for controlling the movement of the power receiving portion 1101*a*. When the process cartridge is installed in the imaging device and the power receiving portion 1101*a* interferes with the driving head 50 in the imaging device (as shown in FIG. 4), the power receiving portion 1101*a* is pressed by the driving head 50 to overcome the elastic force of the fourth elastic member 31 to move. When the machine door cover is closed and the driving head 50 is rotated by the imaging device, with the rotation of the driving head 50, the fourth elastic member 31 pushes the power receiving portion 1101*a* toward the direction close to the driving head 50 to achieve the engagement of the claw part 1101*a*2 and the power output arm 50*a* of the driving head 50.

In the present embodiment, preferably, the driving force receiving member 1101 is divided into the three parts to achieve the effect of the movement of the driving force receiving member in the direction perpendicular to its rotation axis direction. Alternatively the driving force receiving member can also be moved as a whole. After the driving force receiving member is moved as a whole, it only needs to reserve in a hollow part of the flange an enough space for the movement of the driving force receiving member.

According to the process cartridge provided by the present embodiment, when the driving force receiving member in the process cartridge interferes with the driving head in the imaging device, the driving force receiving member is driven by the rotation of the driving head to rotate by means of the contact between the driving force receiving member and the driving head so as to overcome the interference state to achieve smooth installation. Meanwhile the process cartridge is obliquely taken out to guarantee the process cartridge is taken out smoothly. The technical problem that the driving force receiving member in the process cartridge cannot be normally engaged with and disengaged from the driving head in the imaging device in the prior art is solved.

The above embodiments are only used for illustrating the technical solutions of the invention, rather than limiting the same. Although the invention has been described in detail with reference to the foregoing embodiments, those skilled in the art should understand that they can still make modifications to the technical solutions recorded in the foregoing embodiments or make equivalent replacements to a part of technical features. These modifications or replacements do not make the essence of the corresponding technical solutions depart from the spirit and scope of the technical solutions of the embodiments of the invention.

What is claimed is:

1. A process cartridge comprising:

a housing;

a driving force receiver configured to receive a rotation driving force from a rotatable driving head of an imaging device, wherein the driving force receiver comprises a pair of claws that protrude in a direction of a rotational axis of the driving force receiver, wherein the claws are arranged along a circumferential direction of the driving force receiver and are located at an end of the driving force receiver, wherein the driving force receiver comprises a power receiving portion, a power transmission portion and a middle connecting portion connecting the power receiving portion and the power transmission portion, wherein the power receiving portion, the power transmission portion and the middle connecting portion constitute an Oldham coupler;

a flange configured to rotate by receiving the rotation driving force from the driving force receiver;

an elastic member configured to urge the power receiving portion to move relative to the flange in a direction crossing a rotational axis of the flange;

wherein during installation of the process cartridge into the imaging device, after the power receiving portion abuts the rotatable driving head, the power receiving portion overcomes a force from the elastic member to move to a position in which a rotational axis of the power receiving portion is offset from a rotational axis of the rotatable driving head; and the power receiving portion keeps abutting the rotatable driving head;

wherein during rotation of the rotatable driving head, an output arm of the rotatable driving head drives at least one of the pair of claws, causing the driving force receiver to rotate;

wherein when the output arm causes the driving force receiver to rotate, the elastic member urges the power receiving portion to move to a position in which the rotational axis of the power receiving portion is the same as the rotational axis of the rotatable driving head and the power receiving portion engages the rotatable driving head.

2. The process cartridge according to claim 1, wherein when the elastic member urges the claws to move, a distance between the power receiving portion and the flange in a direction of the rotational axis of the flange remains the same.

3. The process cartridge according to claim 1, wherein the claws are spaced apart by an opening; wherein during installation of the process cartridge into the imaging device, a through direction of the opening faces the rotatable driving head.

4. The process cartridge according to claim 1, further comprising a bracket fixed on the housing;

wherein the elastic member is on the bracket;

wherein one end of the elastic member abuts the bracket and another end of the elastic member abuts the power receiving portion.

5. The process cartridge according to claim 1, wherein the power transmission portion is configured and positioned to engage the flange and be co-axial with the flange.

6. The process cartridge according to claim 1, wherein when the claws abut the rotatable driving head to move, the elastic member accumulates elastic potential energy;

wherein during rotation of the rotatable driving head, the elastic member uses of the accumulated elastic potential energy to provide an urging force to the driving force receiver, thereby urging the driving force receiver to move along the direction crossing the rotational axis of the flange.

7. The process cartridge according to claim 1, wherein the elastic member is upstream in an installation direction relative to the driving force receiver.

8. The process cartridge according to claim 1, further comprising a bracket fixed on the housing, wherein the elastic member is on the bracket.

9. The process cartridge according to claim 8, wherein one end of the elastic member abuts the bracket and another end of the elastic member abuts the power receiving portion.

* * * * *